US005378325A

United States Patent [19]

Dastolfo, Jr. et al.

[11] Patent Number: 5,378,325

[45] Date of Patent: Jan. 3, 1995

[54] PROCESS FOR LOW TEMPERATURE ELECTROLYSIS OF METALS IN A CHLORIDE SALT BATH

[75] Inventors: Leroy E. Dastolfo, Jr., Lower Burrell; ALfred F. LaCamera, Trafford, both of Pa.

[73] Assignee: Aluminum Company of America, Pittsburgh, Pa.

[21] Appl. No.: 85,191

[22] Filed: Jun. 30, 1993

Related U.S. Application Data

[63] Continuation-in-part of Ser. No. 761,414, Sep. 17, 1991, Pat. No. 5,279,715.

[51] Int. Cl.[6] ..... C25C 3/00

[52] U.S. Cl. ..... 204/66; 204/67; 204/68; 204/70

[58] Field of Search ..... 204/64 R, 67, 70, 68, 204/66

[56] References Cited

U.S. PATENT DOCUMENTS

| | | | |
|---|---|---|---|
| 2,915,442 | 12/1959 | Lewis | 204/67 |
| 2,915,443 | 12/1959 | Wallace et al. | 204/67 |
| 3,718,550 | 2/1973 | Hans-Jurgen Klein | 204/67 |
| 3,852,173 | 12/1974 | Jacobs et al. | 204/67 |
| 3,951,763 | 4/1976 | Sleppy et al. | 204/67 |
| 3,960,678 | 6/1976 | Alder | 204/67 |
| 3,996,117 | 12/1976 | Graham et al. | 204/67 |
| 4,098,669 | 7/1978 | DeNora et al. | 204/252 |
| 4,233,148 | 11/1980 | Ramsey et al. | 204/291 |
| 4,454,015 | 6/1984 | Ray et al. | 204/293 |
| 4,455,211 | 6/1984 | Ray et al. | 204/293 |
| 4,478,693 | 10/1984 | Ray | 204/64 |
| 4,500,406 | 2/1985 | Weyand et al. | 204/293 |
| 4,620,905 | 11/1986 | Tarcy et al. | 204/64 |
| 4,620,915 | 11/1986 | Öhlin | 204/284 |
| 4,681,671 | 7/1987 | Duruz | 204/67 |
| 5,015,343 | 5/1991 | LaCamera et al. | 204/67 |
| 5,279,715 | 1/1994 | LaCamera et al. | 204/64 R |

OTHER PUBLICATIONS

Kirk-Othmer Encyclopedia of Chemical Technology, 3d Ed., vol. 2, p. 146 John Wiley & Sons, New York (1978).

Electrochemistry Principles & Applications, Edmund C. Potter, Cleaver-Hume Press, London (1961), pp. 129, 322-325.

The Encyclopedia of Electrochemistry, Clifford A. Hampel, Ed., Reinhold Publishing Corporation, New York (1964), p. 36.

*Primary Examiner*—John Niebling
*Assistant Examiner*—Brendan Mee
*Attorney, Agent, or Firm*—Glenn E. Klepac

[57] ABSTRACT

A low temperature salt bath for the electrolysis of metal oxides to produce the corresponding metal. The bath comprises a first salt, comprised of at least one fluoride salt, and a second salt, comprised of at least one chloride salt. The fluoride salt increases the metal oxide solubility in the molten salt bath, and the chloride salt reduces the bath liquidus temperature of the salt bath. The preferred process of practicing the invention includes using an anode consisting essentially of carbonaceous material and having an effective surface area about equal to the projected surface area of the anode.

23 Claims, 4 Drawing Sheets

PROCESS FOR LOW TEMPERATURE ELECTROLYSIS OF METALS IN A CHLORIDE SALT BATH

PENDING RELATED APPLICATION

This application is a continuation-in-part of copending LaCamera et al U.S. Ser. No. 07/761,414, filed Sept. 17, 1991 (now U.S. Pat. No. 5,279,715, issued Jan. 18, 1994).

FIELD OF THE INVENTION

The present invention relates to the low temperature electrolysis of oxides, specifically the production of aluminum from alumina dissolved in low melting temperature salt baths, particularly chloride-containing salt baths.

BACKGROUND OF THE INVENTION

The Hall-Heroult process was first used commercially around 1890. In this process, aluminum is extracted by electrolyzing aluminum oxide, $Al_2O_3$, (also known as "alumina") dissolved in a molten salt bath based on cryolite, $Na_3AlF_6$ and other additives. The molten cryolite is operated at a high temperature, generally within the range of 940°–1000° C. The alumina is dissolved in the bath and electrolyzed using carbon anodes according to the reaction:

$$Al_2O_3+3/2C \rightarrow 2Al+3/2CO_2$$

In the electrolytic cell, a carbon lining within a crucible typically serves as the cathode; and the anodes, typically carbon, are immersed in the molten salt. The cryolite-aluminum oxide serves as the electrolyte solution. A large electric current in the cell supplies thermal energy that melts the cryolite, which dissolves the aluminum oxide. Aluminum is electrolyzed in the molten state, in which state it collects in the bottom of the cell, also serving as the cathode.

The Hall process is beset with numerous disadvantages, however, which have not been completely solved despite over a century of commercial use. Operating the salt bath used in the process at high temperatures, typically around 970° C., requires large amounts of energy. Attempts at operating the salt bath at lower temperatures by progressively lowering bath weight ratios below the 1.1:1 NaF to $AlF_3$ bath ratios typically used have been frustrated by the formation of a crust of frozen electrolyte over the molten aluminum as electrolysis proceeds. This crust causes deposition of sodium. which in turn hampers current efficiency and drastically increases resistance at the cathode and reduces metal coalescence to the point that the cell can no longer be operated.

Another serious drawback to the conventional Hall cell technology is the lack of an adequate construction material to contain the molten bath. At the high cell temperatures necessary to maintain alumina in solution, the electrolyte and molten aluminum progressively react with most ceramic materials, creating problems of containment and cell design. As a result, the smelting cells are operated with a high heat loss to produce a frozen layer of bath all around the sides and top of the cell, which protect the cell's graphite-lined sidewalls from corrosion. This mode of operation causes a high energy expenditure and imposes difficulties in operating near the freezing point of the bath because of large variabilities in the thickness of the frozen ledge for small differences in bath temperature.

Other disadvantages of the Hall cell include sodium intercalation and formation of sodium aluminum oxide which causes heaving and cracking of the cell lining with resulting interference in operating characteristics of the cell and shortened cell life.

Numerous methods have been attempted to overcome some or all of the above shortcomings of the Hall process. While many of these methods have met with some success, none has replaced the conventional Hall process in commercial applications. One attempt has been to utilize so-called "low temperature" salt baths which allow reduced energy consumption at the expense of lower alumina solubility. For example, U.S. Pat. No. 3,951,763 discloses a low temperature salt bath and uses a carbon anode, which is consumed in the process. U.S. Pat. No. 3,996,117 adds 5–10 wt. % LiF to the bath.

One of the drawbacks of the low temperature salt bath technology to date has been the realization that reduction of salt bath temperature likewise leads to reduction of alumina solubility. Attempts to overcome this problem include those disclosed in U.S. Pat. No. 3,852,173 wherein the alumina is provided with a sufficient water content to prevent anode dusting, which water content also assists in dispersing the alumina into the low temperature salt bath solution of $NaF/AlF_3$. However, providing the water-containing alumina is an added requirement of the process and naturally incurs added expense.

Various attempts have been made to utilize so-called "inert" anodes in order to improve the Hall process. See, e.g., U.S. Pat. Nos. 3,718,550; 3,960,678; 4,098,669; 4,233,148; 4,454,015; 4,478,693; 4,620,905; 4,620,915 and 4,500,406. Attempts have also been made to use inert anodes with low temperature salt baths. U.S. Pat. No. 4,455,211 discloses a low temperature salt bath of $NaF/AlF_3$ which teaches the addition of 1–15% LiF and an inert anode made of an interwoven matrix. LaCamera et al U.S. Pat. No. 5,015,343 discloses the use of an inert anode in connection with a metal chloride and/or metal fluoride salt bath using additives for low temperature aluminum electrolysis. However, this reference teaches alumina solubilities less than 0.6% and the need to increase the anode surface area by 2 to 15 times the superficial, or projected, anode area. Such increased surface area anodes are typically fabricated, for example, by drilling numerous holes deep into the anode.

U.S. Pat. No. 4,681,671 discloses a low temperature salt bath which is used in conjunction with an anode having a relatively large surface area and low current density. Indeed, this reference teaches the necessity of utilizing a low current density and increased anode surface area in conjunction with low temperature salt baths.

A great advantage would be gained if a bath composition could be found which was not corrosive to conventional lining materials and contained favorable attributes for electrolysis; namely, high conductivity, appreciable alumina solubility and low melting point. This would permit elimination of the frozen ledge and allow for more thermally efficient cell designs which are more economical than those presently used. Greater operating flexibility would also be gained because cells could be operated comfortably above the electrolyte melting point, making cell temperature less critical. Until this time, no suitable bath substitutes could be found to fulfill these requirements.

OBJECTS OF THE INVENTION

Accordingly, it is an object of the invention to provide a process for the production of metals, particularly aluminum, by the electrolysis of the corresponding metal oxides dissolved in a molten electrolyte at low temperatures using a carbonaceous anode without the need to increase the anode surface area or decrease the current density at the anode relative to commercial current densities.

It is another object of the invention to provide a process for the production of metal by the electrolysis of metal oxides, such as alumina, which can be performed by retrofitting existing metal-producing, e.g., aluminum-producing, electrolyte-containing cells.

It is another object of the invention to provide a novel, low-temperature salt bath which is especially effective for the production of aluminum by the electrolysis of $Al_2O_3$.

It is still a further object of the invention to provide a molten salt bath composition which is substantially non-corrosive to conventional crucible lining materials yet offers relatively high conductivity, appreciable alumina solubility and low melting point.

It is yet another object of the invention to provide a molten salt bath which allows for the elimination of a frozen ledge and permits use of more thermally efficient and economical cell designs than are currently possible.

It is another object of the invention to provide a molten salt bath which offers greater operating flexibility than is currently possible and is operable at a sufficient temperature above the electrolyte melting point to make bath temperature less critical than in present systems.

SUMMARY OF THE INVENTION

We have surprisingly found a low temperature salt bath composition which may be used at commercial current densities and in commercial electrolytic cells in connection with low surface area carbonaceous anodes.

A preferred process of practicing the invention comprises electrowinning metal in a low temperature melt by passing a current between an anode and a cathode in a molten salt bath containing an oxide of the metal. The molten salt bath preferably comprises a first salt and a second salt which is miscible with the first salt. The first salt comprises at least one fluoride salt capable of increasing the metal oxide solubility in the molten salt bath. The second salt comprises at least one chloride salt capable of reducing the bath liquidus temperature of the molten salt bath. The anode consists essentially of carbonaceous material and has an effective surface area about 1.0 to 1.3 times the projected surface area of the anode. As used herein, the term "projected surface area" means the projected area of the anode onto a horizontal plane. The effective surface area of the anode is preferably about equal to its projected surface area.

In one preferred embodiment of the invention, the first salt is selected from the group consisting of $AlF_3$, NaF, $Na_3AlF_6$ (cryolite), KF, $MgF_2$, $CaF_2$ and LiF, and the second salt is selected from the group consisting of NaCl, KCl, LiCl, $MgCl_2$ and $CaCl_2$.

In another preferred embodiment of the invention, the first and second salts are non-hygroscopic.

In a most preferred embodiment of the invention, the first salt comprises cryolite, and the second salt comprises NaCl, KCl or a mixture thereof. In a highly preferred embodiment of the invention, the salt bath comprises about 0–70% NaCl, 0–70% KCl and 10–70% cryolite.

The improved bath allows for adequate alumina solubility while operating at significantly lower temperatures. Current efficiency improvements may result from a lower solubility of metal in the bath at the lower bath temperature. The density of the improved bath is only about 1.74 g/cc compared to about 2.2 g/cc of standard cryolitic baths. This lower density improves the stability of the bath-metal interface and allows the opportunity for reduced interpolar distance. Also, the chloride-fluoride bath electrical conductivity is higher than conventional fluoride baths, effectively reducing resistive losses in the electrolyte. Finally, the improved bath is substantially non-corrosive to the graphite cell linings, allowing for the possibility of eliminating the frozen ledge and improving the heat balance and operability of the cell.

These and other advantages and other preferred embodiments of the invention will become more readily apparent as the following detailed description of the invention proceeds.

DETAILED DESCRIPTION OF THE INVENTION

Figure 1:
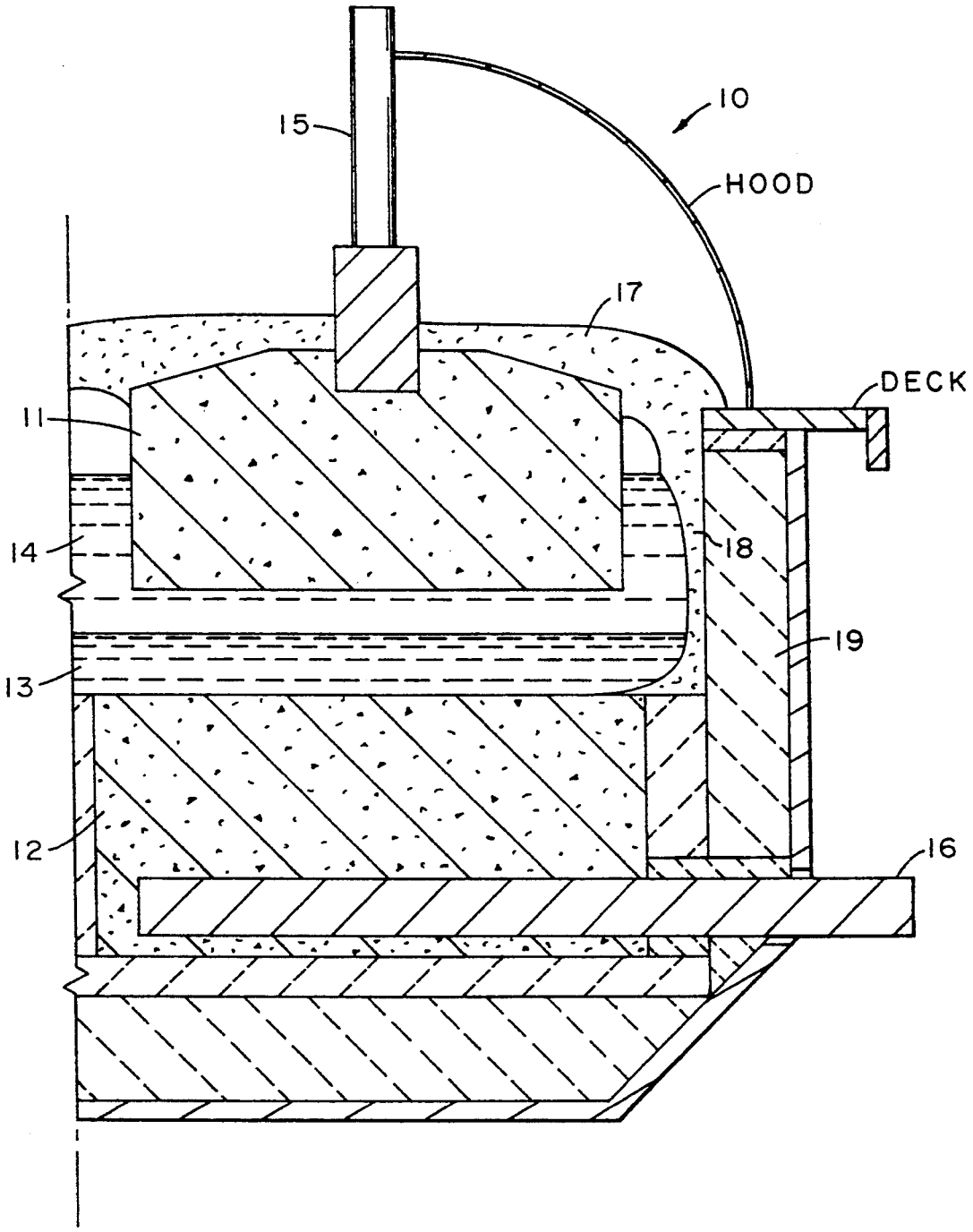
FIG. 1 illustrates a cross-sectional view of half of a traditional metal electrolysis cell which may be used in practicing the present invention.
Figure 2:
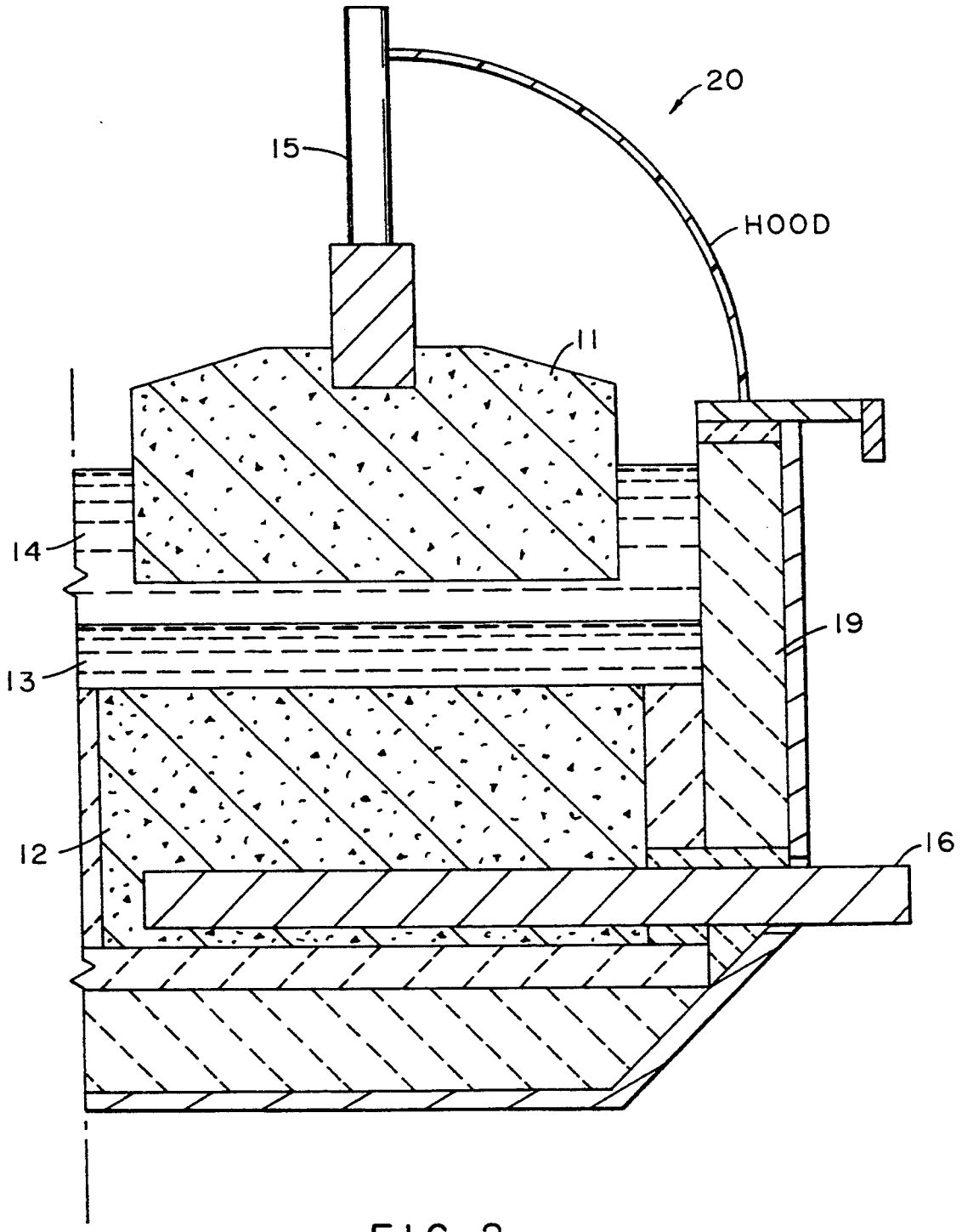
FIG. 2 illustrates a cross-sectional view of half of a modified metal electrolysis cell which may be used in practicing the present invention.

A traditional aluminum electrolysis cell 10 which may be used in practicing the present invention is shown in FIG. 1. A modified aluminum electrolysis cell 20 is shown in FIG. 2. Both cells 10, 20 include an anode 11, cathode 12, molten metal 13 and a molten salt bath or melt 14. A metal anode rod 15 passes current to the anode 11, and a metal collector bar 16 is connected to the cathode 12. As shown in FIG. 1, a solid crust 17 overlies the salt bath 14, and a solid ledge 18 is situated between the bath 14 and a sidewall 19. Both the crust 17 and ledge 18 are eliminated in the modified cell of FIG. 2.

A mixture of salts is heated to form the molten bath 14 which contains an oxide of the metal to be recovered in solution with the molten salt mixture, preferably in saturated solution. Gas generated at the anode 11 may be used to improve circulation in the bath 14 and metal oxide to assist in achieving saturation. A current is passed between the anode 11 and the cathode 12 through the melt 14. The current maintains the melt 14 at the preferred temperature, preferably at least 25° C. above the melting point of the metal being recovered, if the cell is operated substantially free of a frozen sidewall of the bath. For recovery of aluminum, the bath temperature is preferably less than 900° C. and most preferably at 685°–850° C. A current density preferably in the range of 0.5–3.0 $A/cm^2$ is maintained at anode 11, and molten metal 13 is recovered.

The metal oxide may be selected from the group of aluminum oxide, iron oxide, magnesium oxide, silicon dioxide, titanium dioxide, lithium oxide, lead oxide, zirconium oxide and zinc oxide, in order to produce aluminum, iron, magnesium, silicon, titanium, lithium, lead, zirconium and zinc, respectively. Other metal oxides could be used and their corresponding metals recovered using the present invention, as will be appreciated by those skilled in the art.

As the electrolysis proceeds, there may be some loss of fluoride or chloride salts through vaporization. It is desirable, when fluoride or chloride salt losses become significant, to add makeup fluoride or chloride salt to the bath to maintain substantially the same bath ratio and to maintain bath depth.

The salt bath composition of the present invention comprises a first salt and a second salt, the first salt being miscible with the second. The first salt comprises at least one fluoride salt capable of increasing the solubility of a metal in the molten salt bath. This first salt is preferably selected from the group $AlF_3$, NaF, $Na_3AlF_6$ (cryolite), KF, $MgF_2$, $CaF_2$, LiF and mixtures thereof.

In the case of aluminum recovery, most preferably the first salt comprises a mixture of NaF and $AlF_3$ in an NaF:$AlF_3$ weight ratio of about 1.5 to 3.0. It is not desirable to operate with an NaF:$AlF_3$ ratio of less than 1.5 (which is the composition of cryolite) because free $AlF_3$ would react with any moisture in the alumina feed to produce HF and $Al_2O_3$. In addition, HCl would be formed by the reaction:

$$6NaCl+4AlF_3+3H_2O \rightarrow 6HCl+2Na_3AlF_6+Al_2O_3$$

Operation at a NaF:$AlF_3$ ratio of greater than 1.5 also reduces fluoride loss from the bath. The first salt is preferably present in the bath in a quantity to allow sufficient alumina solubility to permit electrolysis at commercially acceptable anodic current densities, i.e., up to about 3 A/cm$^2$. Preferably, the alumina solubility in the bath is greater than about 1.0%.

The amount of first salt, or fluoride salt, used in the bath should also be sufficient to allow the bath to achieve anode effect without significantly decomposing the second salt. We have found that this is the case when the fluoride salt, such as cryolite, is present in an amount of about 10–70% in the molten salt bath.

One of the problems of the prior art Hall cell, which uses virtually all cryolite, is the high melting bath temperatures required for cryolite and the corrosive nature of this salt, which requires use of a frozen "ledge" of bath to protect the crucible walls from corrosion. The present invention solves this problem by including in the salt bath a second salt comprising at least one chloride salt capable of reducing the bath liquidus temperature of the molten salt bath. Preferably, this second salt is selected from the group NaCl, KCl, LiCl, $MgCl_2$ and $CaCl_2$ and mixtures thereof. Most preferably, the second salt comprises NaCl or KCl or a mixture thereof.

The second salt is present in the molten salt in sufficient quantity to impart wettability characteristics to the melt, such that the molten salt bath sufficiently wets the anode so as to inhibit anode effect. Preferably, in the case of aluminum production, the second salt comprises NaCl, KCl or a mixture thereof. Thus, a preferred embodiment of the invention utilizes a molten salt bath comprising about 30–90% NaCl plus KCl and about 10–70% NaF plus $AlF_3$. In a highly preferred embodiment of the invention, the molten salt bath comprises about 15–35% NaCl, 25–45% KCl and 30–50% cryolite. All percentages are expressed in weight percent, absent a clear statement to the contrary.

The anode of the present invention consists essentially of carbonaceous material and has an effective, or active, surface area about equal to the projected surface area of the anode. The anode preferably operates at a current density of 0.5 to 3.0 A/cm$^2$. As used herein, the term "essentially carbonaceous" refers to both graphite and carbon anodes.

In addition to the above-noted advantages of the present invention, the molten salt bath of the invention is sufficiently benign to graphitic materials to permit the elimination, under certain conditions, of a frozen ledge of bath to protect the cell sidewalls and the use of more thermally efficient cell designs than is currently commercially possible. The lower melting point allows operation of the cell at 685°to 850° C., which is about 100°to 300° C. lower than conventional cells, further improving thermal efficiency and current efficiency.

This invention demonstrates that anode current densities significantly higher than those achieved using commercial aluminum smelting electrolytes at low alumina concentrations are possible. Examples 5 through 7 below show that current densities from 1.4 to 3.0 A/cm$^2$ are achieved in the bath salt system of the invention, which has a measured alumina solubility of 1.2 wt. %. Commercial Hall electrolytes incur an anode effect when operating in this range of current density and alumina concentration, demonstrating the unexpected results of the present invention. This anode effect is caused by a dewetting phenomenon between the anode and the electrolyte with decreasing alumina or increasing current density. This dewetting phenomenon is thought to be caused by the production of $CF_4$ at the anode surface through decomposition of the fluoride bath. Larger and larger bubbles form at the anode due to dewetting which leads to an anode effect. It is further hypothesized that for the chloride-fluoride salt systems of the present invention, good wetting between the electrolyte and the anode is maintained at high current densities or low alumina contents without the increase in bubble size. In this mode, the gas evolution from the anode enhances mass transfer of the oxygen-containing species at the anode-electrolyte interface as the current density is increased. This results in the high current densities obtained.

Figure 3:
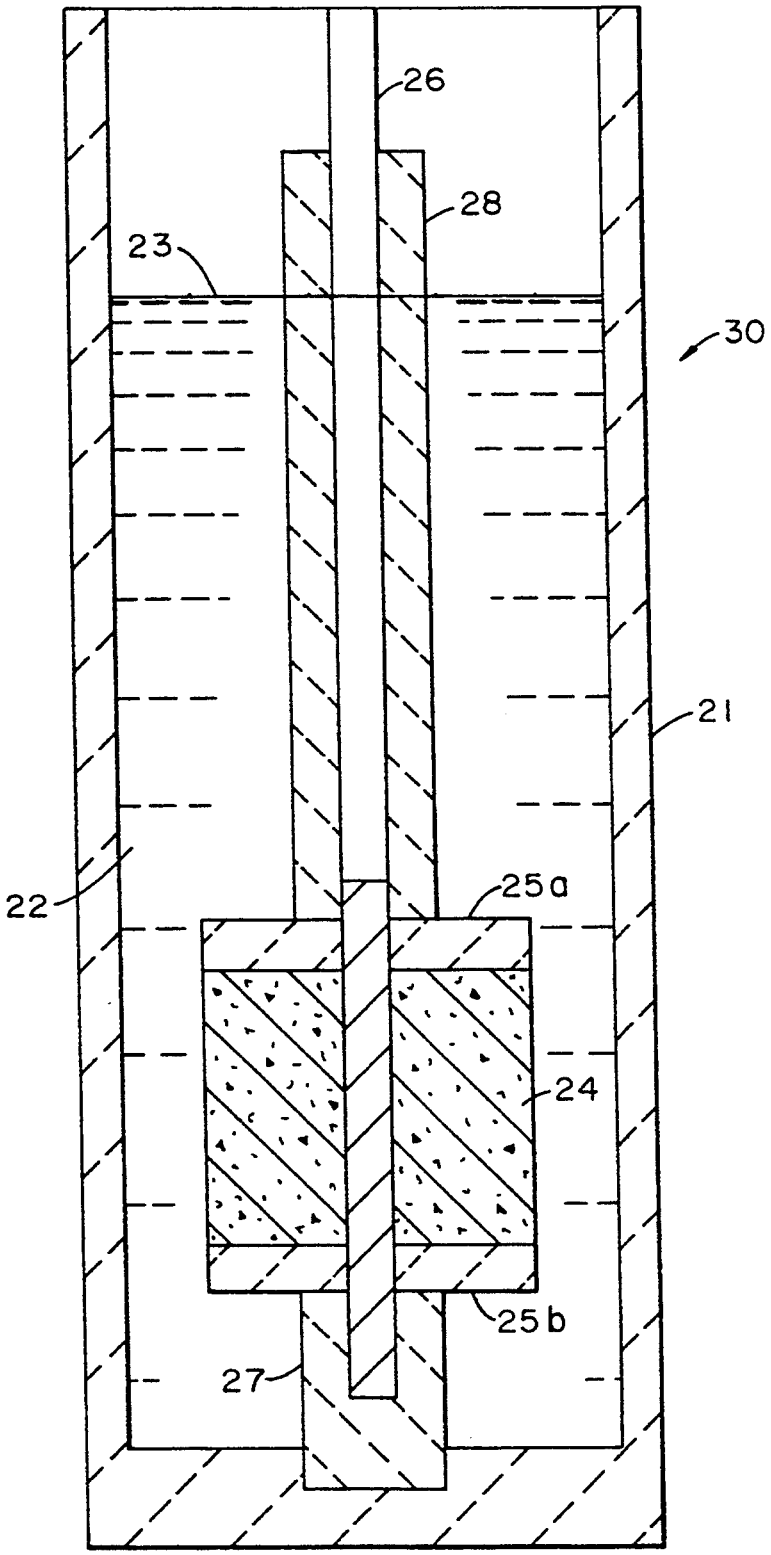
FIG. 3 illustrates a bench scale cell useful in practicing preferred embodiments of the present invention.

A bench scale electrolysis cell 30 of the type used in the examples described below is shown in FIG. 3. The cell 30 includes a graphite crucible or cathode 21 containing a molten salt bath 22 having a bath level 23. A graphite anode 24 is capped at upper and lower ends with boron nitride caps 25*a*, 25*b*. The anode 24 receives current through a nickel current rod 26. A boron nitride anode holder 27 maintains the anode 24 in a stationary position. A boron nitride sleeve 28 protects the anode holder 27 from attack by the salt bath 22.

EXAMPLE 1

A bath consisting of 307.6 g NaCl, 392.4 g KCl and 300.0 g $Na_3AlF_6$ was mixed, charged into a graphite crucible similar to that illustrated in FIG. 3 and brought to a temperature of 800° C. A high purity alumina disk, 25 mm in diameter and weighing 18.906 g was suspended horizontally on a graphite rod in the bath and rotated at 400 rpm for 24 hours. The disk was then removed, washed, dried and reweighed, revealing a weight loss of 7.629 g. A new disk was inserted, and the process was repeated a total of three more times until no more appreciable weight loss was incurred by the disks. The total weight loss of all disks amounted to 0.807% of the initial bath weight. Analysis of the initial bath indicates a starting alumina concentration of 0.3% and final alumina concentration of 1.2%. Alumina concentration was calculated from the excess aluminum content above the stoichiometric requirement of aluminum in the $Na_3AlF_6$, based on fluoride analysis.

EXAMPLE 2

The same bath composition and crucible as in Example 1 were used except this time the cell contained a graphite anode and cathode and an Ag/AgCl reference electrode. Masses of 3 g each of $Al_2O_3$ were added successively to the bath until a total of 15 g had been added. During the additions, a constant voltage was applied while monitoring current output. With each successive addition, current increased to a lesser degree until after 12 g had been added, no more increase in current was observed. An increase in current after each alumina addition was interpreted as a sign that alumina was being dissolved into the bath. When no more increases were observed, the bath was saturated. The 12 g of alumina correspond to 1.2% of the total bath weight.

EXAMPLE 3

The same bath composition as in Examples 1 and 2 was used but with no electrolysis conducted. Successive 3 g alumina additions were made while stirring the bath. After sufficient time for settling, bath samples were taken after each alumina addition. Analysis of the bath samples showed alumina concentration leveled out at about 1.8% from an original concentration of 0.7% for a difference of 1.1%. The above results indicate that the molten salt bath of the present invention permits alumina solubility in the bath of greater than 1.0%.

A series of experiments were conducted to measure the anodic current density at the point of chlorine generation for various cryolite concentrations in the NaClKCl-cryolite bath of the invention. Chlorine generation occurred at 1.5, 0.74 and 0.4 A/cm$^2$ at 20, 15 and 10% cryolite. At 25% cryolite, no chlorine generation was observed, up to 2.75 A/cm$^2$. This supports additional fundamental-scale data where chlorine generation occurred at 0.77–0.81 A/cm$^2$ at 16.4% cryolite, 1.52 A/cm$^2$ at 19.7% cryolite and 0.22 A/cm$^2$ at 8.9% cryolite.

EXAMPLE 4

An electrolysis cell 30 shown in FIG. 3 was constructed to determine the maximum anode current density that could be applied before bath decomposition occurred, which would be detectable by the presence of chlorine in the cell offgas. A bath composition of 30% cryolite, 30.76% NaCl and 39.24% KCl was used as in previous examples. A cylindrical graphite disk 24 attached to a nickel current rod 26 served as the anode. The anode top and bottom were capped by boron nitride caps **25*a*, 25*b* to prevent stray current flow, and the nickel rod 26 was provided with a sleeve 28 for the same purpose. The graphite crucible 21 served as the cathode. An Ag/AgCl reference electrode (not shown) was used. Alumina was pre-fed to the cell bath 22** to the saturation point of 1.2% and thereafter fed at a rate consistent with 100% current efficiency. The cell was purged with Ar and the offgas passed through a solution of potassium iodide (KI) to detect chlorine. The electrolysis was conducted starting at 0.8 A/cm$^2$ and continuing for 30 minutes at each interval up to 1.4 A/cm$^2$. No chlorine was detected during the entire run.

EXAMPLE 5

An electrolytic cell was operated as in the above examples except with the addition of 200 g of tabular alumina in the bottom to provide continuous alumina saturation. Bath composition was the same as in Example 1. No powdered alumina was fed during the run. No chlorine was detected at 2.0 A/cm$^2$, while chlorine breakthrough was detected at 2.25 A/cm$^2$.

EXAMPLE 6

An electrolytic cell was operated as in Example 5. Anodic current density was increased from 2.25 to 3.0 A/cm$^2$. Bath composition was the same as in Example 1. No chlorine breakthrough was detected at any time during the run.

EXAMPLE 7

A bath with composition 32.96 wt. % NaCl, 42.04% KCl and 25.00% cryolite was heated to 800° C. in a graphite crucible. Smelting grade alumina was added to a level of 1% of the bath weight to saturate the bath. Electrolysis was started using a graphite anode and the crucible as the cathode. Alumina was periodically added to maintain saturation. Anodic current density was gradually increased from zero to 2.5 A/cm$^2$, at which point anode effect was observed, manifested by an increase in voltage and decrease in current. No bath decomposition was observed as evidenced by a lack of chlorine generation at the anode.

EXAMPLE 8

A bath of composition 35.15 wt. % NaCl, 44.85% KCl and 20% cryolite with alumina added to a level of 0.8% of the bath weight to saturate the bath was subjected to the same electrolysis as in Example 7. Anodic current density was gradually increased from zero to 1.5 A/cm$^2$, at which point bath decomposition began to occur, manifested by the presence of chlorine in the cell offgas.

EXAMPLE 9

A bath of composition 37.35 wt. % NaCl, 47.65% KCl and 15% cryolite with alumina added to a level of 0.6% of the bath weight to saturate the bath was subjected to the same electrolysis as in Example 7. Anodic current density was gradually increased from zero to 0.75 A/cm$^2$, at which point bath decomposition began to occur, manifested by the presence of chlorine in the cell offgas.

EXAMPLE 10

A bath of composition 39.55 wt. % NaCl, 50.45% KCl and 10 % cryolite with alumina added to a level of 0.4% of the bath weight to saturate the bath was subjected to the same electrolysis as in Example 7. Anodic current density was gradually increased from zero to 0.4 A/cm$^2$, at which point bath decomposition began to occur, manifested by the presence of chlorine in the cell offgas.

EXAMPLE 11

An electrolysis cell was operated to determine the bath composition which avoids chlorine generation under alumina depletion conditions. The cell consisted of a 4.5 inch inside diameter by 11.5 inch tall graphite crucible which was cathodically polarized and a 2 inch diameter by 5 inch long cylindrical carbon anode. A bath consisting of 50 wt. % cryolite, 22 wt. % NaCl and 28 wt. % KCl with a total weight of 2000 g was charged to the cell, and 30 g $Al_2O_3$ was added to the bath. The bath temperature averaged 825° C. The cell offgas was passed through a bubbler containing a 1M KI solution for detection of chlorine. A 30 ampere DC current was passed through the electrolyte, equivalent to approximately 0.75 A/cm$^2$ anodic current density. After 37.8 A-hrs of electrolysis, anode effect was observed. No chlorine was generated. Another 20 g $Al_2O_3$ were then added to the bath and electrolysis started. After 53.4 A-hrs, anode effect was again observed without any chlorine generation. Again, 20 g $Al_2O_3$ was added to the bath and electrolysis started. Current density was raised to 1.0 A/cm$^2$. After 108.6 A-hrs, anode effect was observed with no chlorine generation. Another 20 g $Al_2O_3$ was added to the bath and electrolysis started. Current density was raised to 1.5 A/cm$^2$. After 72.6 A-hrs, anode effect was observed with no chlorine generation.

EXAMPLE 12

The electrolysis cell of Example 11 was operated with 2000 g of bath composed of 40 wt. % cryolite, 33.6 wt. % KCl and 26.4 wt. % NaCl to which 30 g $Al_2O_3$. was added. Electrolysis was started using an anodic current density of 0.75 A/cm$^2$. After 31.8 A-hrs, anode effect was observed, with no chlorine generation. Another 30 g $Al_2O_3$ was added to the bath and electrolysis restarted at 1.0 A/cm$^2$. After 51.6 A-hrs. anode effect was observed, with no chlorine generation. Another 30 g $Al_2O_3$ was added to the bath and electrolysis restarted at 1.5 A/cm$^2$. Anode effect was observed after 27.6 A-hrs, with no chlorine generation.

EXAMPLE 13

The electrolysis cell of Example 11 was operated with 2000 g of bath composed of 30 wt. % cryolite, 39.2 wt. % KCl and 30.8 wt. % NaCl to which 30 g $Al_2O$was added. Electrolysis was started using an anodic current density of 0.75 A/cm$^2$. After 14.4 A-hrs, anode effect was observed, with no chlorine generation. Another 30 g $Al_2O_3$ was added to the bath and electrolysis restarted at 1.0 A/cm$^2$. Anode effect was observed after 26.4 A-hrs, with no chlorine generated. With a slight adjustment to the anode immersion area, the test was continued at 1.0 A/cm$^2$. Anode effect again occurred after 9.0 A-hrs, with no chlorine generation. Another 30 g $Al_2O_3$ was added to the bath and electrolysis restarred at 1.5 A/cm$^2$. This time, chlorine generation occurred after 31.8 A-hrs. The bath composition was then adjusted to 50 wt. % cryolite by the addition of 333 g of cryolite. 30 g $Al_2O_3$ was added to the bath and electrolysis started at 1.5 A/cm$^2$. After 50.4 A-hrs, anode effect occurred with no chlorine generation.

The above examples demonstrate that the salt bath of the present invention may be operated at commercial current densities without chlorine breakthrough. If adequate cryolite is present, the depletion of alumina leads to an anode effect rather than $Cl_2$ generation caused by decomposition of the electrolyte.

Figure 4:
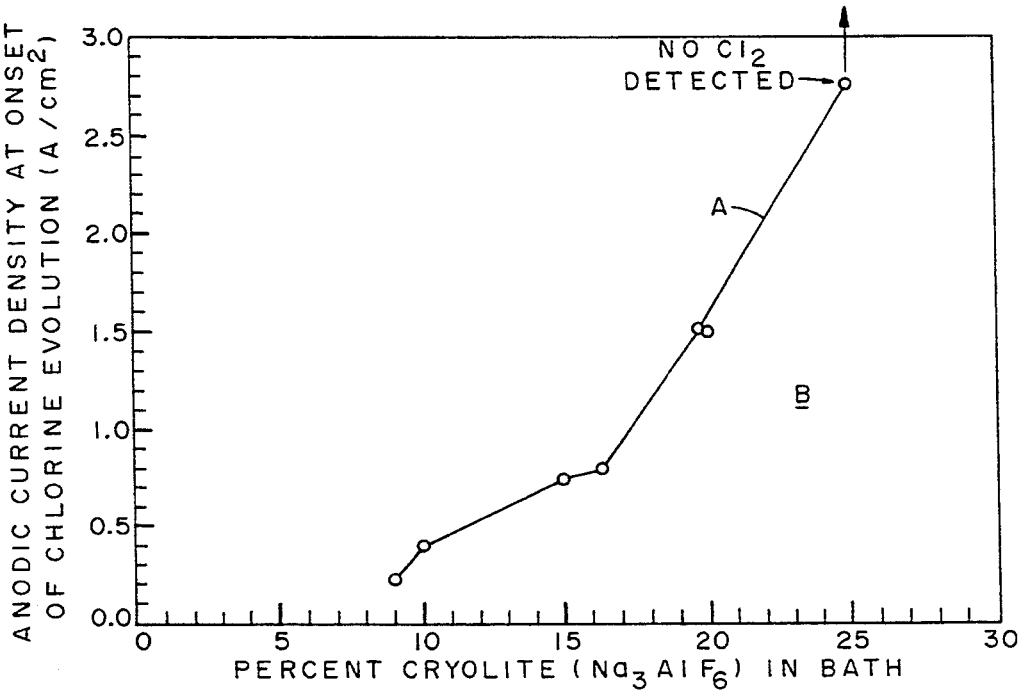
FIG. 4 illustrates graphically chlorine breakthrough as a function of anode current density and cryolite content for salt bath compositions of the present invention.

FIG. 4 illustrates graphically the maximum current density achievable using the salt bath of the present invention prior to the onset of chlorine breakthrough as a function of cryolite composition in the bath. The region B below the curve A represents the operating parameters for avoiding chlorine breakthrough.

It will be appreciated by those skilled in the art that variations on the invention described herein are possible without departing from the spirit of the invention as set forth in the following claims.

Having thus described the invention, what is claimed is:

1. A process for electrowinning metal in a low temperature melt having a temperature at least about 20° C. above the melting point of said metal and less than about 900° C. comprising passing a current between an anode and a cathode in a molten salt bath containing an oxide of a metal selected from the group consisting of aluminum, magnesium, zinc, lithium and lead, said molten salt bath comprising a first salt and a second salt, said second salt being miscible with said first salt, said first salt comprising about 30–50 wt. % cryolite for increasing the solubility of said oxide in said molten salt bath, said second salt comprising about 15–35 wt. % NaCl and about 25–45 wt. % KCl for reducing the bath liquidus temperature of said molten salt bath, said anode consisting essentially of carbonaceous material.

2. The process of claim 1 wherein said first salt and second salt are non-hygroscopic.

3. The process of claim 1 wherein said cryolite has an $NaF:AlF_3$ weight ratio of from about 1.5 to 3.0.

4. The process of claim 1 wherein said anode is operated at a current density of about 0.5–3.0 A/cm$^2$ and said oxide of said metal is alumina, said alumina having a solubility in said bath of greater than about 1.0 wt. %.

5. The process of claim 1 wherein said electrowinning is accomplished free of a frozen sidewall of said bath.

6. The process of claim 1 wherein said anode operates at a current density of about 2.5 A/cm$^2$ or less.

7. A process for electrowinning aluminum in a low temperature melt having a temperature of less than about 900° C. comprising passing a current between an anode and a cathode in a molten salt bath containing alumina, said molten salt bath comprising cryolite and at least one metal chloride, said metal chloride selected from the group consisting of KCl, NaCl, LiCl, $MgCl_2$, $CaCl_2$ and mixtures thereof and imparting wettability to said anode to delay anode effect, said alumina having a solubility in said bath of greater than about 1%.

8. The process of claim 7 wherein said anode consists essentially of carbonaceous material.

9. The process of claim 7 wherein said alkali metal chloride is selected from the group consisting of KCl, NaCl, LiCl, $MgCl_2$, $CaCl_2$, and mixtures thereof.

10. The process of claim 7 wherein said salt bath comprises about 15–35 wt. % NaCl, about 25–45 wt. % KCl and about 30–50 wt. % cryolite.

11. The process of claim 7 wherein said low temperature melt has a temperature at least about 20° C. above the melting point of aluminum.

12. The process of claim 13 wherein said anode operates at a current density of about 0.5–3 A/cm$^2$ substantially without chlorine breakthrough.

13. The process of claim 7 wherein said molten salt bath operates free of a frozen sidewall.

14. The process of claim 7 wherein said cryolite has an $NaF:AlF_3$ weight ratio of about 1.5–3.0 and said metal chloride comprises NaCl, KCl or a mixture thereof.

15. The process of claim 7 wherein said salt bath comprises about 30–90 wt. % NaCl or KCl or a mixture thereof and about 10–70 wt. % cryolite.

16. The process of claim 7 wherein said salt bath wets said anode so as to inhibit anode effect.

17. The process of claim 7 wherein said salt bath includes sufficient cryolite to cause said bath to achieve anode effect without decomposing said metal chloride.

18. The process of claim 7 wherein said anode operates at a current density of about 2.5 $A/cm^2$ or less.

19. A process for electrowinning aluminum in a low temperature melt having a temperature of less than about 900° C. comprising passing a current between an anode and a cathode in a molten salt bath containing alumina dissolved in a bath comprising about 15–35 wt. % sodium chloride, about 25–45 wt. % potassium chloride and about 30–50 wt. % cryolite, said bath allowing an alumina solubility of greater than about 1 wt. %, said anode consisting essentially of carbonaceous material and operating at a current density of about 0.5–3.0 $A/cm^2$.

20. The process of claim 19 wherein said low temperature melt has a temperature at least about 20° C. above the melting point of aluminum.

21. The process of claim 19 wherein said molten salt bath operates free of a frozen sidewall.

22. The process of claim 19 wherein said cryolite has an $NaF:AlF_3$ weight ratio of about 1.5–3.0.

23. The process of claim 19 wherein said anode operates at a current density of about 2.5 $A/cm^2$ or less.

* * * * *

UNITED STATES PATENT AND TRADEMARK OFFICE

CERTIFICATE OF CORRECTION

PATENT NO. : 5,378,325

DATED : January 3, 1995

INVENTOR(S) : LeRoy E. Dastolfo Jr. et al.

It is certified that error appears in the above-identified patent and that said Letters Patent is hereby corrected as shown below:

Col. 1, before line 6

Insert the following paragraph:

"GOVERNMENT CONTRACT

This invention was made with Government support under Contract No. DE-FC07-891D12848 awarded by the Department of Energy. The Government has certain rights in this invention."

Signed and Sealed this

Twenty-fifth Day of July, 2000

*Attest:*

*Attesting Officer*

Q. TODD DICKINSON

*Director of Patents and Trademarks*